US009562403B2

(12) United States Patent
Otten et al.

(10) Patent No.: US 9,562,403 B2
(45) Date of Patent: Feb. 7, 2017

(54) RISER TENSIONER CONDUCTOR FOR DRY-TREE SEMISUBMERSIBLE

(71) Applicant: Seahorse Equipment Corp, Houston, TX (US)

(72) Inventors: Jeffrey Douglas Otten, Cypress, TX (US); Peimin Cao, Sugar Land, TX (US); Thomas Prichard, Houston, TX (US)

(73) Assignee: Seahorse Equipment Corp., Houston, TX (US)

( * ) Notice: Subject to any disclaimer, the term of this patent is extended or adjusted under 35 U.S.C. 154(b) by 95 days.

(21) Appl. No.: 14/252,592

(22) Filed: Apr. 14, 2014

(65) Prior Publication Data

US 2014/0305655 A1 Oct. 16, 2014

Related U.S. Application Data

(60) Provisional application No. 61/812,106, filed on Apr. 15, 2013.

(51) Int. Cl.

| | |
|---|---|
| ***E21B 19/02*** | (2006.01) |
| ***E21B 17/10*** | (2006.01) |
| ***E02D 5/40*** | (2006.01) |
| ***B63B 21/00*** | (2006.01) |
| ***B63B 35/44*** | (2006.01) |

(Continued)

(52) U.S. Cl.

CPC ..... *E21B 19/002* (2013.01)

(58) Field of Classification Search

None

See application file for complete search history.

(56) References Cited

U.S. PATENT DOCUMENTS 6,161,620 A * 12/2000 Cox ..... E21B 19/004 166/359

6,648,074 B2 11/2003 Finn et al.

(Continued)

FOREIGN PATENT DOCUMENTS

WO WO-2013062735 A2 * 5/2012 ..... E21B 17/01

WO WO 2013062735 A2 * 5/2013 ..... E21B 19/006

OTHER PUBLICATIONS

International Search Report and Written Opinion regarding corresponding PCT Application No. PCT/US2014/034044, dated Aug. 28, 2014.

*Primary Examiner* — Matthew R Buck

*Assistant Examiner* — Douglas S Wood

(74) *Attorney, Agent, or Firm* — Blank Rome, LLP

(57) ABSTRACT

A top-tensioned riser system comprises a substantially vertical riser extending upward from the seafloor; a conductor surrounding an upper portion of the riser in spaced-apart relation; a coaxial keel guide surrounding a lower portion of the conductor; a tensioner attached to the conductor and the riser; a keel guide support structure attached to the keel guide and connected to the keel of a dry-tree, semi-submersible vessel; and, a keel joint centralizer attached to the riser proximate the keel guide and sized to prevent radial movement of the riser relative to the conductor. Side loads on the riser (such as those arising from displacement of the vessel from its nominal position or currents acting on the riser) are reacted from the riser to the conductor via the keel joint centralizer and then to the keel of the vessel via the keel guide.

35 Claims, 11 Drawing Sheets

(51) Int. Cl.
*E21B 17/01* (2006.01)
*E21B 19/00* (2006.01)

(56) References Cited

U.S. PATENT DOCUMENTS

| | | | | |
|---|---|---|---|---|
| 7,013,824 | B2 * | 3/2006 | Otten | B63B 21/502 114/264 |
| 7,503,728 | B2 * | 3/2009 | Martin et al. | 405/195.1 |
| 7,588,393 | B1 * | 9/2009 | Shivers, III | E21B 19/004 166/352 |
| 7,632,044 | B2 | 12/2009 | Pallini et al. | |
| 7,886,828 | B1 | 2/2011 | Shivers, III et al. | |
| 8,021,081 | B2 * | 9/2011 | Crotwell | E21B 19/002 166/355 |
| 8,123,438 | B2 | 2/2012 | Pallini et al. | |
| 8,944,723 | B2 * | 2/2015 | Garcia et al. | 405/224.4 |
| 2004/0123359 | P1 * | 6/2004 | Utecht | A01H 5/0277 |
| 2004/0182297 | A1 * | 9/2004 | Wybro | E21B 19/004 114/230.1 |
| 2005/0123359 | A1 * | 6/2005 | McCarty | E21B 19/006 405/224.4 |
| 2007/0048094 | A1 | 3/2007 | Mao et al. | |
| 2007/0056739 | A1 | 3/2007 | Ellis | |
| 2008/0304916 | A1 | 12/2008 | Crotwell et al. | |
| 2009/0279958 | A1 | 11/2009 | Heidari | |
| 2011/0048728 | A1 * | 3/2011 | Carlsen et al. | 166/345 |
| 2012/0247783 | A1 | 10/2012 | Berner, Jr. et al. | |

* cited by examiner

RISER TENSIONER CONDUCTOR FOR DRY-TREE SEMISUBMERSIBLE

CROSS-REFERENCE TO RELATED APPLICATIONS

This application claims the benefit of U.S. Provisional Application No. 61/812,106, filed on Apr. 15, 2013.

STATEMENT REGARDING FEDERALLY SPONSORED RESEARCH OR DEVELOPMENT

Not Applicable

BACKGROUND OF THE INVENTION

1. Field of the Invention

The present invention generally relates to the offshore production of oil and gas. More particularly, it concerns dry-tree, vertical risers supported by semisubmersible vessels.

2. Description of the Related Art including information disclosed under 37 CFR 1.97 and 1.98

A semi-submersible is floating unit with its deck(s) supported by columns to enable the unit to become almost transparent for waves and provide favorable motion behavior. The unit stays on location using dynamic positioning and/or is moored by means of catenary mooring lines terminating in piles or anchors in the seafloor. A DeepDraft-Semi® platform is a semi-submersible unit fitted with oil and gas production facilities in ultra deep water conditions. The unit is designed to optimize vessel motions to accommodate steel catenary risers (SCRs)—steel pipes hung in a catenary configuration from a floating vessel in deep water to transmit flow to or from the sea floor.

The "christmas tree" (or "tree") is an assembly of valves at the top of the tubing of a completed well that are used to control the flow of oil and/or gas and to enable certain manipulations. If the christmas tree is at the level of the seabed, the well is described as "subsea completed" or "wet tree." If the tree is on the deck of a platform, the well is described as "surface completed" or "dry tree."

A dry tree semi (DTS) is a floating facility carrying surface-completed wells, i.e. the christmas trees are located above the surface of the sea, on the semi-submersible, as opposed to the seabed.

The rigid pipes (tubing, casing, etc.) that link the trees to the wells require high tension to avoid buckling. The DTS is therefore under constant tension to compensate for the heave motion of the vessel.

Generally, a DTS also carries basic drilling equipment to allow down-hole intervention on a tender assist mode. It may also feature full drilling capability.

A well bay is an area of an offshore platform where the christmas trees and wellheads are located. It normally consists of two levels, a lower level where the wellheads are accessed and an upper level where the trees are accessed often along with the various well-control panels, which typically have pressure gauges and controls for the hydraulically actuated valves, including downhole safety valve and annular safety valve. On a platform with a drilling package, the well bay will be located directly below it to facilitate access for drilling and well interventions.

Spar type platforms have incorporated a conductor and a keel joint centralizer when using air cans for riser tensioning. These conductors are large and part of the air can assembly. Installation or removal requires a heavy-lift vessel for handling. These systems generally have steel-on-steel contact for the keel guide, and therefore impart large axial tension variations to the risers. Alternatively, hydro-pneumatic tensioners have been used to tension the risers. Each known example of these systems has had four cylinders per riser.

Tension configuration (hanging cylinders) have been used on six-cylinder configurations on certain tension leg platforms and on deepwater drilling vessels using the N-Line™ direct acting riser tensioning system (National Oilwell Varco, Houston, Tex. 77036).

U.S. Pat. No. 6,648,074 to Finn et al. describes a gimbaled table riser support system for a spar type floating platform having risers passing vertically through the center well of a spar hull. The gimbaled table is supported above the top of the spar hull. The table is supported by a plurality of non-linear springs attached to the top of the spar hull. The non-linear springs compliantly constrain the table rotationally so that the table is allowed a limited degree of rotational movement with respect to the spar hull in response to wind- and current-induced environmental loads. Larger capacity non-linear springs are located near the center of the table for supporting the majority of the riser tension, and smaller capacity non-linear springs are located near the perimeter of the table for controlling the rotational stiffness of the table. The riser support table comprises a grid of interconnected beams having openings through which the risers pass. The non-linear springs may take the form of elastomeric load pads or hydraulic cylinders. The upper ends of the risers are supported from the table by riser tensioning hydraulic cylinders that may be individually actuated to adjust the tension in and length of the risers. Elastomeric flex units or ball-in-socket devices are disposed between the riser tensioning hydraulic cylinders and the table to permit rotational movement between the each riser and the table.

U.S. Pat. No. 7,013,824 to Otten et al. discloses a riser centralizer for transferring lateral loads from the riser to a platform hull which includes a keel centralizer mounted on a keel joint. The keel centralizer is received within a keel guide sleeve secured in a support mounted at the lower end of the platform hull. The keel centralizer includes a nonmetallic composite bearing ring having a radiused peripheral profile for minimizing contact stresses between the keel centralizer and the keel guide sleeve in extremes of riser and platform motion. The internal surface of the keel guide sleeve is clad with a corrosion resistant alloy and coated with a wear resistant ceramic rich coating.

U.S. Pat. No. 7,632,044 to Pallini et al. describes a ram style tensioner with a fixed conductor and a floating frame. The riser tensioner for an offshore floating platform has a frame mounted to the upper portion of the riser. Pistons and cylinders are spaced circumferentially around the riser and connected between the frame and the floating platform. A tubular guide member is mounted to the floating platform for movement in unison in response to waves and currents. The riser extends through the guide member. A guide roller support is mounted to and extends downward from the frame around the guide member. A set of guide rollers is mounted to the guide roller support in rolling engagement with the guide member as the guide member moves in unison with the platform.

U.S. Pat. No. 8,123,438 to Pallini et al. describes a ram style tensioner that includes a frame configured to be fixedly attached to the riser; plural cylinder assemblies spaced around the riser, each cylinder assembly having a cylinder and a piston configured to slidably move inside the cylinder, the piston being configured to connect to the frame; a guide roller support stationarily mounted to and extending from the frame; at least one bearing fixedly attached to the guide roller support; and a guide member configured to be in rolling engagement with the at least one bearing as the cylinder moves relative to the frame.

U.S. Pat. No. 7,588,393 to Shivers et al. describes a method for supporting top-tensioned drilling and production risers on a floating vessel using a tensioner assembly above the waterline of the vessel. The method may include attaching at least one hydraulic cylinder on a first end to a first position on a floating vessel and on a second end to a tension frame below the first position. The next step of the method may be forming a fluid connection between the at least one hydraulic cylinder and at least one primary accumulator.

U.S. Pat. No. 7,886,828 to Shivers et al. describes a floating vessel for supporting top tensioned drilling and production risers having a hull and an operation deck disposed on top of the hull. The tensioner assembly moveably carries a conductor that communicates from a wellhead to a piece of well access equipment. The well access equipment is connected to the floating vessel. The tensioner assembly is supported by the floating vessel.

For a Dry Tree Semi (DTS) platform, a tensioning system is needed that can provide large strokes (on the order of 30 to 45 feet) and also provide sufficient support and alignment to the risers. Connecting jumpers of production riser christmas trees and drilling riser blowout preventers (BOP's) must be free to move as required by the platform motions without impacting deck or tensioning system components while preventing riser clashing. In addition, the semi-submersible configuration lends itself to a two-main-deck configuration and, due to the tensioner stroke required and the need for access to the christmas trees, tension joints, and BOP's, the tensioning system preferably has a ram or push-up type configuration. By using a push-up tensioner, the tensioner cylinder barrel may be located lower on the deck and enable access to critical areas of the system such as the tension ring and surface trees. In addition, the push-up type arrangement allows for a more compact well bay.

However, a ram type or push-up configuration is susceptible to buckling failure and high lateral loads. What is needed is a method that provides stability to the riser and tensioner while not adversely affecting the low tensioner spring rate that may be required by the DTS design parameters. A keel guide system for the riser is needed to react lateral riser loads directly to the hull structure rather than supporting high riser lateral loads at the tensioner and deck interface. Reacting riser lateral loads at the pontoon level of a semi-submersible may also improve the overall stability of the platform.

BRIEF SUMMARY OF THE INVENTION

A riser system according to the invention provides a conductor of sufficient size to support the required lateral loads at the keel and allow the running of drilling and production tieback connectors through the inside. The conductor is mechanically attached to the upper tensioner frame and moves with the tensioner in response to platform motions. The conductor interfaces with a keel guide and the tensioner rollers on the outside of the conductor. On the inside of the conductor, the production or drilling risers may be equipped with one or more centralizers to transmit lateral forces from the risers to the conductor. A conductor head on the top conductor section provides a profile for a spaceout adapter that supports the production riser and allows space out of the riser and tensioner.

BRIEF DESCRIPTION OF THE SEVERAL VIEWS OF THE DRAWING(S)

DETAILED DESCRIPTION OF THE INVENTION

Figure 1:
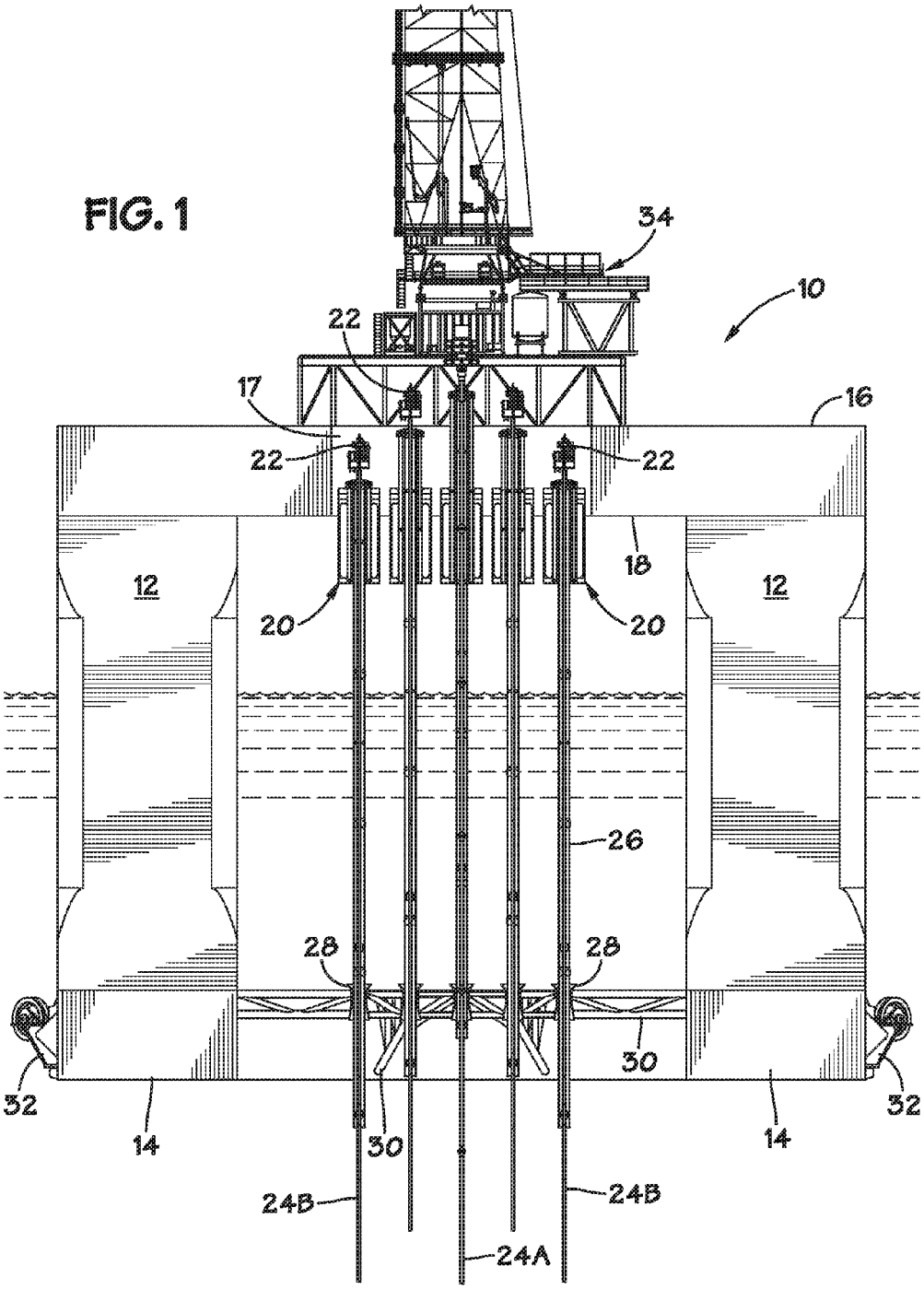
FIG. 1 is a schematic side view through the well bay of a dry-tree semi-submersible equipped with a vertical riser tensioning system according to one embodiment of the invention.

The invention may best be understood by reference to the exemplary embodiments illustrated in the drawing figures wherein the following reference numbers are used:

10 dry-tree semi-submersible offshore vessel ("DTS")
12 columns
14 pontoons
15 top surface of pontoon
16 upper deck level
17 well bay
18 lower deck level
19 bottom surface of pontoon
20 tensioners
22 christmas trees
23 tree work platform
24 vertical risers
24A drilling riser
24B production riser
26 conductor
28 keel guide
30 keel guide support structure
32 mooring line fairleads
34 drilling rig
36 SCR porches
38 tensioner cylinder rod; tensioner ram

40 high-pressure bottle
42 upper tensioner guide rollers
44 lower tensioner guide rollers
46 conductor connectors
48 riser centralizer
50 riser tension joint
52 conductor flare
54 drilling riser connector
55 riser connector
56 adjustable centralizing dog
58 attachment block
60 anti-friction bearing
62 riser keel joint
64 radial plates
66 anti-friction bearing
68 elastomeric bearing
70 centralizer mount
72 elastomer bearing
74 spaceout adapter
78 conductor head
80 upper tensioner frame
82 conductor annulus sealing plate
84 annulus
86 tension ring
88 flange
90 outer land
92 inner land
94 radial wings
96 keel joint centralizer
98 tensioner upper frame and spaceout adapter
100 concave spherical section of tensioner ring
102 convex spherical section of spaceout adapter
104 spherical section elastomer bearing
106 connector box
108 connector pin
110 locking engagement profile
112 tool engagement profile
114 connector inner wall
116 conductor inner wall
118 lower end of conductor
120 lower end of keel guide
122 drilling rig substructure
124 blowout preventer ("BOP")
126 cellar deck
128 cellar deck vertical support member
130 cellar deck frame member Referring now to FIG. 1, representative semi-submersible vessel 10 has a conventional configuration comprising surface-piercing columns 12 and subsurface pontoons 14 connecting adjacent columns. One or more decks 16 are supported above the water surface on columns 12.

Semi-submersible 10 is equipped with mooring line fairleads 32 for a catenary mooring system. Mooring lines (not shown) extend from anchors in the seafloor through fairleads 32 and up the outer face of columns 12 to mooring line winches mounted on upper deck level 16 (or the upper ends of columns 12).

A plurality of dry trees 22 are located in well bay 17 on the upper ends of vertical risers 24. In the illustrated embodiment, the center riser in the group of five risers is a drilling riser and has a blowout preventer on its upper end. This riser is directly below the derrick of drilling rig 34. In other embodiments, equipment 34 may comprise production equipment, be a workover rig or any other equipment related to offshore drilling and/or production. Tree work platform 23 may be provided in certain embodiments (see FIG. 4).

Figure 8:
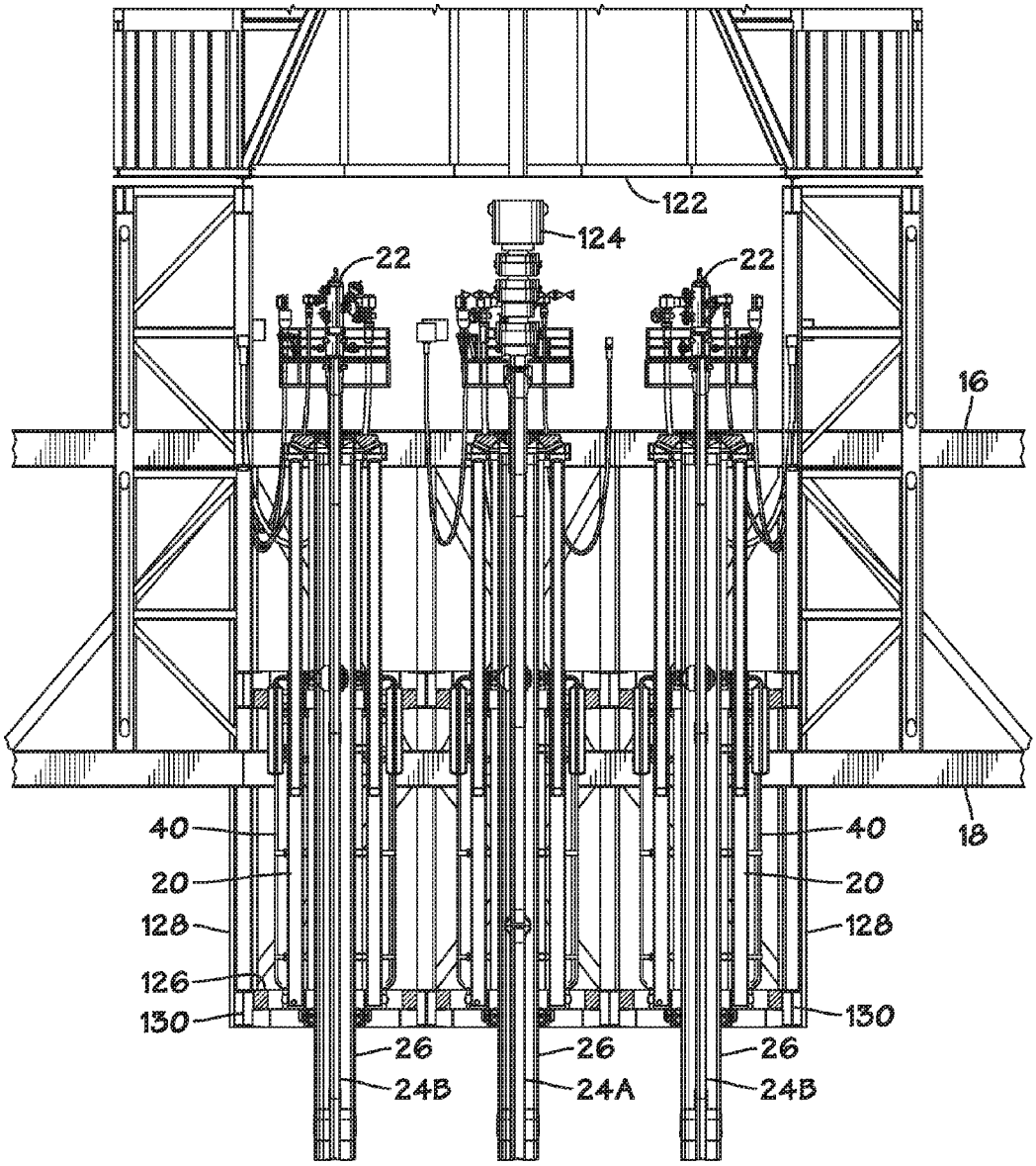
FIG. 8 is a side cross-sectional view of a cellar deck, its supporting structure on a dry-tree semi, and riser tensioners supported from the lower deck.

Vertical risers 24 are attached to ram-type (or "push up") tensioners 20 which are supported on lower deck level 18. For purposes of illustration only, the outer pair of tensioners in FIG. 1 are shown "bottomed out"—i.e. fully stroked down; the center tensioner is shown fully stroked up; and, the middle pair of tensioners is shown in their nominal positions. It will be understood by those skilled in the art that, under normal operating conditions, the rams of tensioners 20 will all be extended approximately the same distance in response to a given platform heave (as shown in FIG. 8).

Figure 2:
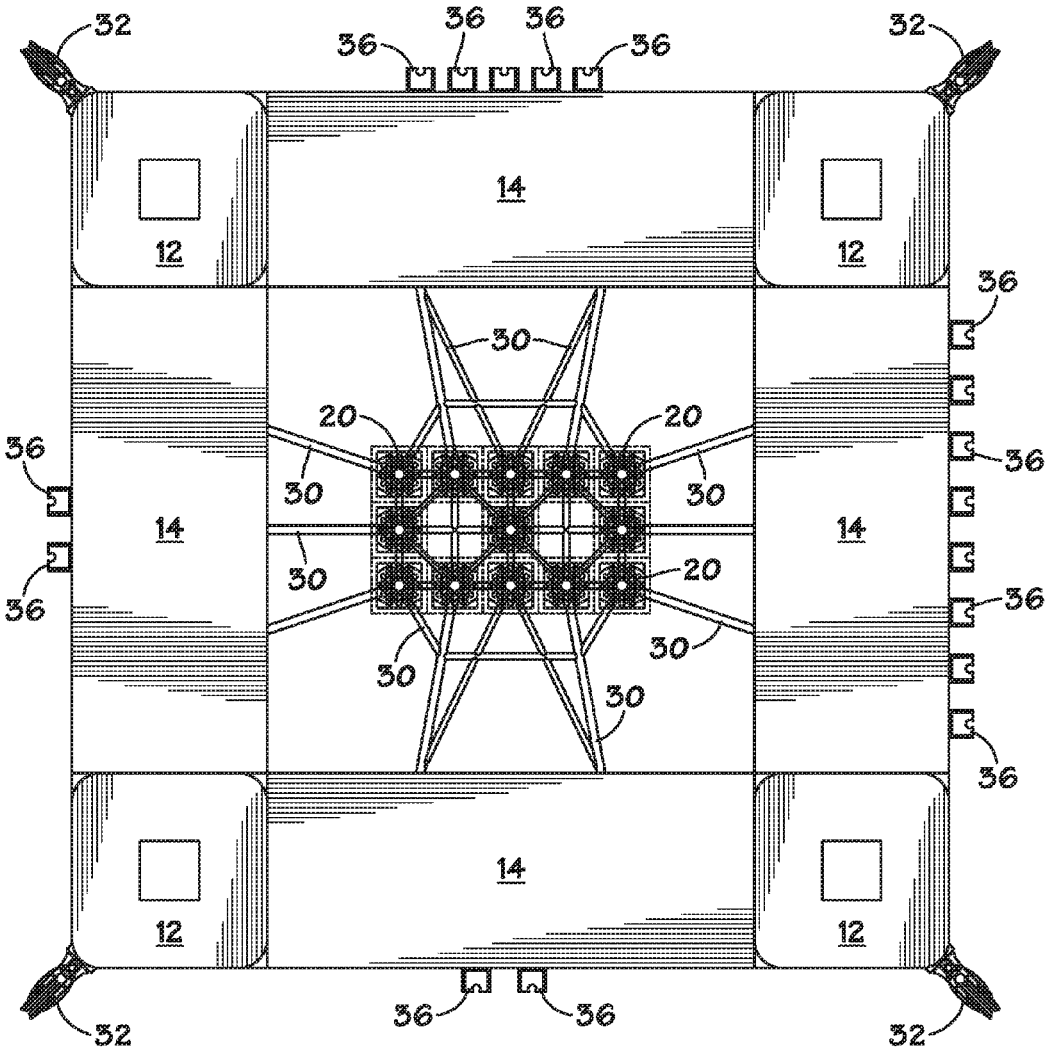
FIG. 2 is a plan view of the dry-tree semi-submersible illustrated in FIG. 1.

Conductors 26 surround each riser 24 proximate the upper end thereof. Conductors 26 extend through keel guides 28 which are mounted on keel guide support structure 30. As may be best seen in the plan view of FIG. 2, keel guide support structure 30 in the illustrated example extends between one or more opposing pairs of pontoons 14. Also shown in FIG. 2 are porches 36 on the outboard surfaces of pontoons 14 for supporting the upper end of steel catenary risers (SCR's) which may be used to connect equipment on semi-submersible 10 to flow lines, pipelines or wellheads on the seafloor.

Figure 3:
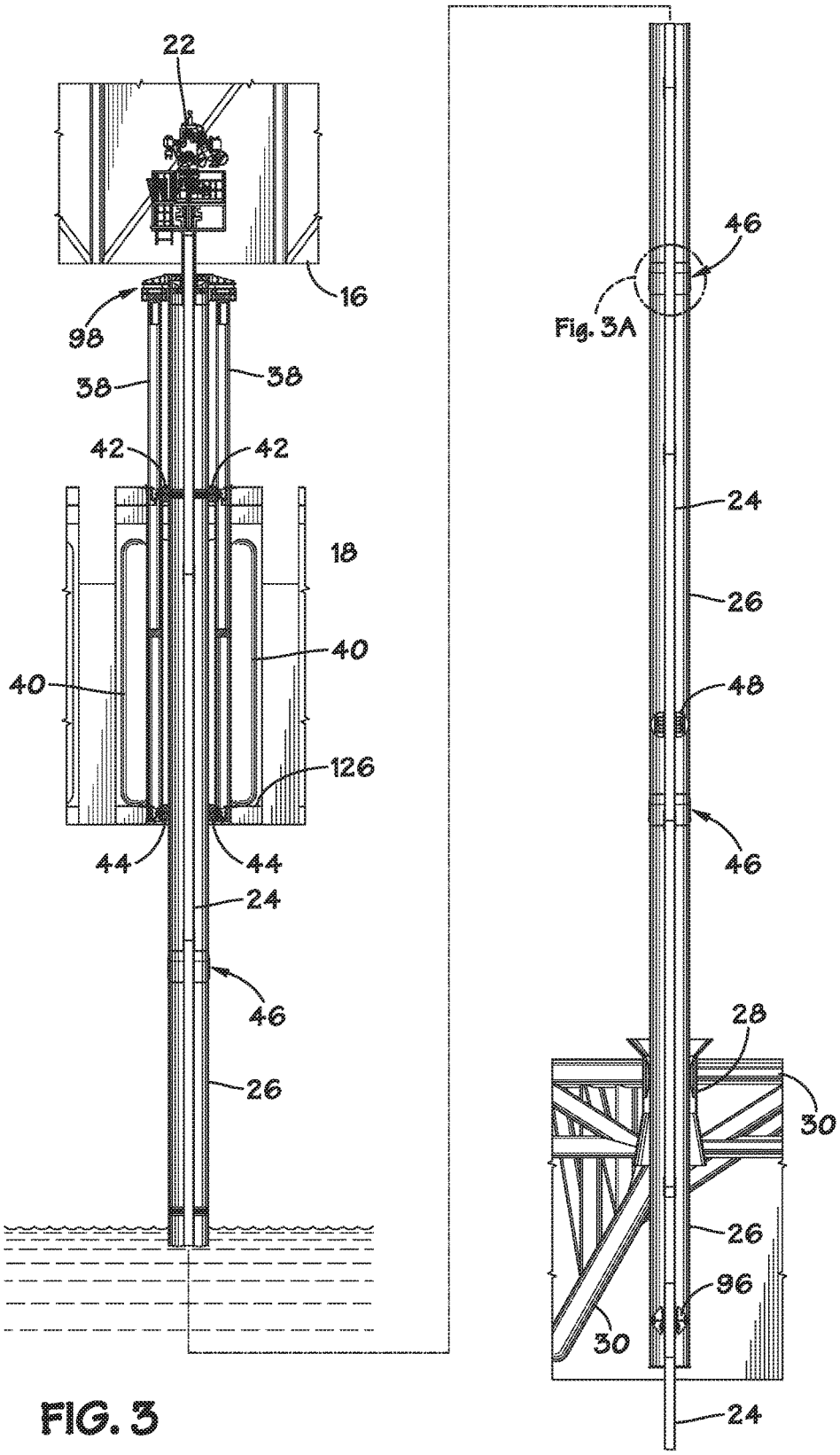
FIG. 3 is a side view, partially in cross-section, of a vertical riser tensioning system according to the invention.

FIG. 3 shows the upper end of an isolated, vertical riser 24 within a conductor 26 according to an embodiment of the invention. Riser 24 extends substantially vertically from a wellhead on the seafloor. An upper portion of riser 24 is surrounded by conductor 26 which may comprise a plurality of segments joined together by mechanical connectors 46. This permits conductor 26 to be assembled and installed offshore without the assistance of a heavy-lift crane vessel. In other embodiments, conductor 26 is a single piece of pipe. In yet other embodiments, conductor 26 may comprise welded or threaded connectors between segments. In certain preferred embodiments, conductor 26 has a smooth, contiguous, substantially cylindrical outer surface at least in the vicinity of tensioner rollers 42 and 44 and keel guide 28.

Figure 3A:
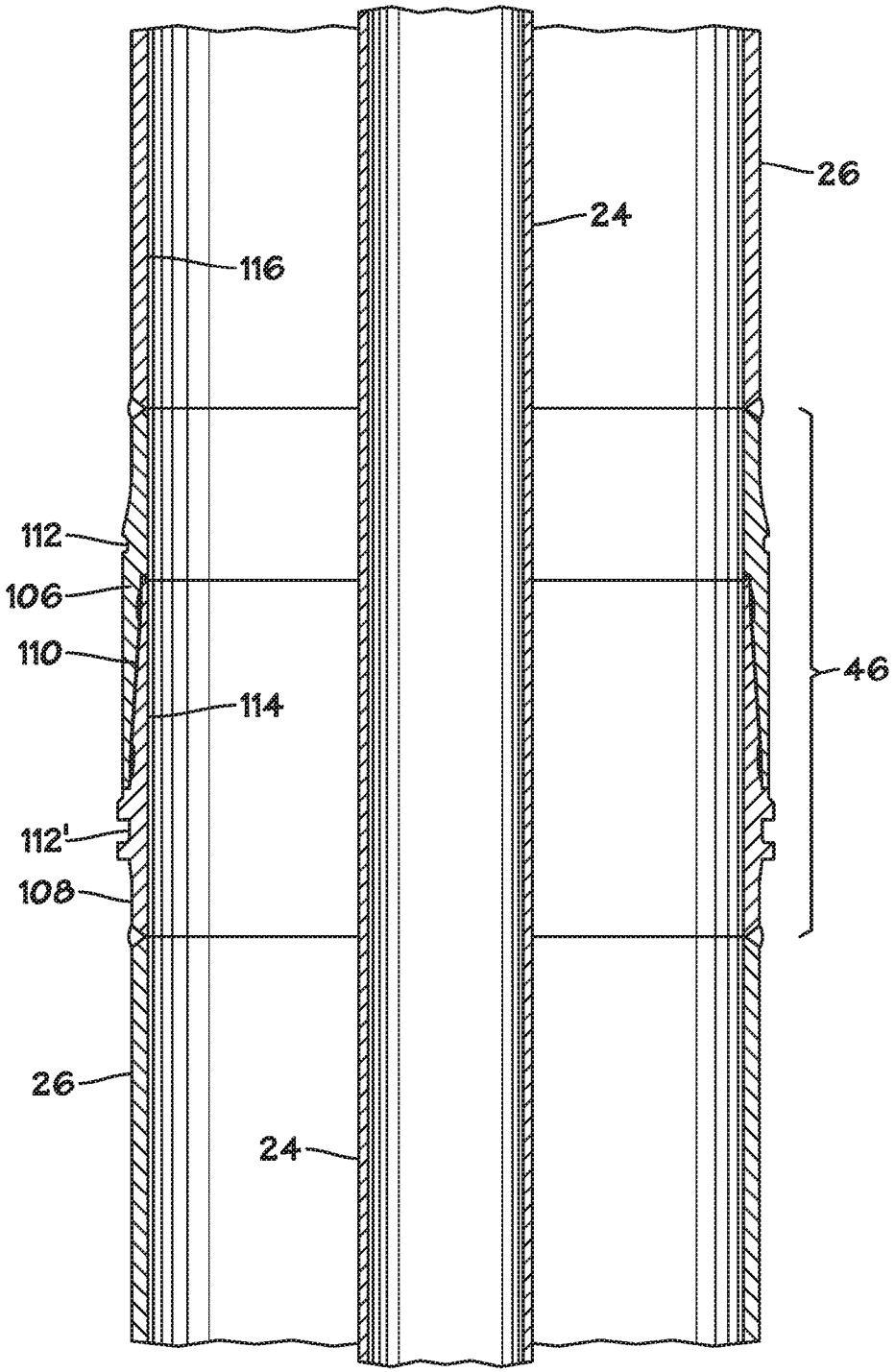
FIG. 3A is a longitudinal, cross-sectional enlargement of the conductor connector indicated in FIG. 3.

One particular preferred mechanical connector 46 is illustrated in FIG. 3A. Connector 46 comprises pin section 108 attached to an upper end of conductor 26 and box section 106 attached to the lower end of an adjoining section of conductor 26. An assembly tool (not shown) which may be a hydraulically-actuated tool, may engage box section 106 at profile 112 and pin section 108 at profile 112'. The assembly tool may urge sections 106 and 108 axially together until they lock together at locking profile 110. Connector 46 may have an inside diameter 114 that is substantially the same as inner diameter 116 of conductor 26 so as to provide a substantially smooth inner bore. This may facilitate the running of riser 24 (together with its associated tieback connectors and centralizers) in and out of conductor 26.

One or more riser centralizers 48 may be attached to riser 24 to position riser 24 centrally within conductor 26. Proximate the lower end of conductor 26, keel joint centralizer 96 may act as a load bearing or "load reactor" to transfer side loads on riser 24 to conductor 26 and thence through keel guide 28 to keel guide support structure 30 thereby reducing side loads imposed on tensioner 20. One particular, suitable keel joint centralizer design is that described in U.S. Pat. No. 7,013,824 to Otten et al., the disclosure of which is hereby incorporated by reference in its entirety. Side loads are imposed on vertical riser 24 whenever semi-submersible 10 drifts from its nominal position due to winds and/or currents. Even when semi-submersible 10 is located at its nominal position directly above the seafloor wellheads, subsurface currents can displace risers 24 from a straight line, vertical orientation.

At the upper end of riser 24, a space out adapter 98 connects riser 24 and conductor 26 and provides a bearing surface for rods 38 of tensioner 20. Conductor 26 is positioned within tensioner 20 by upper tensioner rollers 42 and lower tensioner rollers 44. In other embodiments, a single set of rollers may be employed at 42 and lower tensioner rollers 44 may be omitted.

Tensioner cylinder rods 38 are urged upward, out of their associated cylinders under the influence of fluid pressure within high-pressure bottles 40 which may have a gas-over-liquid configuration or have pressurized gas applied directly to the piston or rod of the cylinders.

Figure 4:
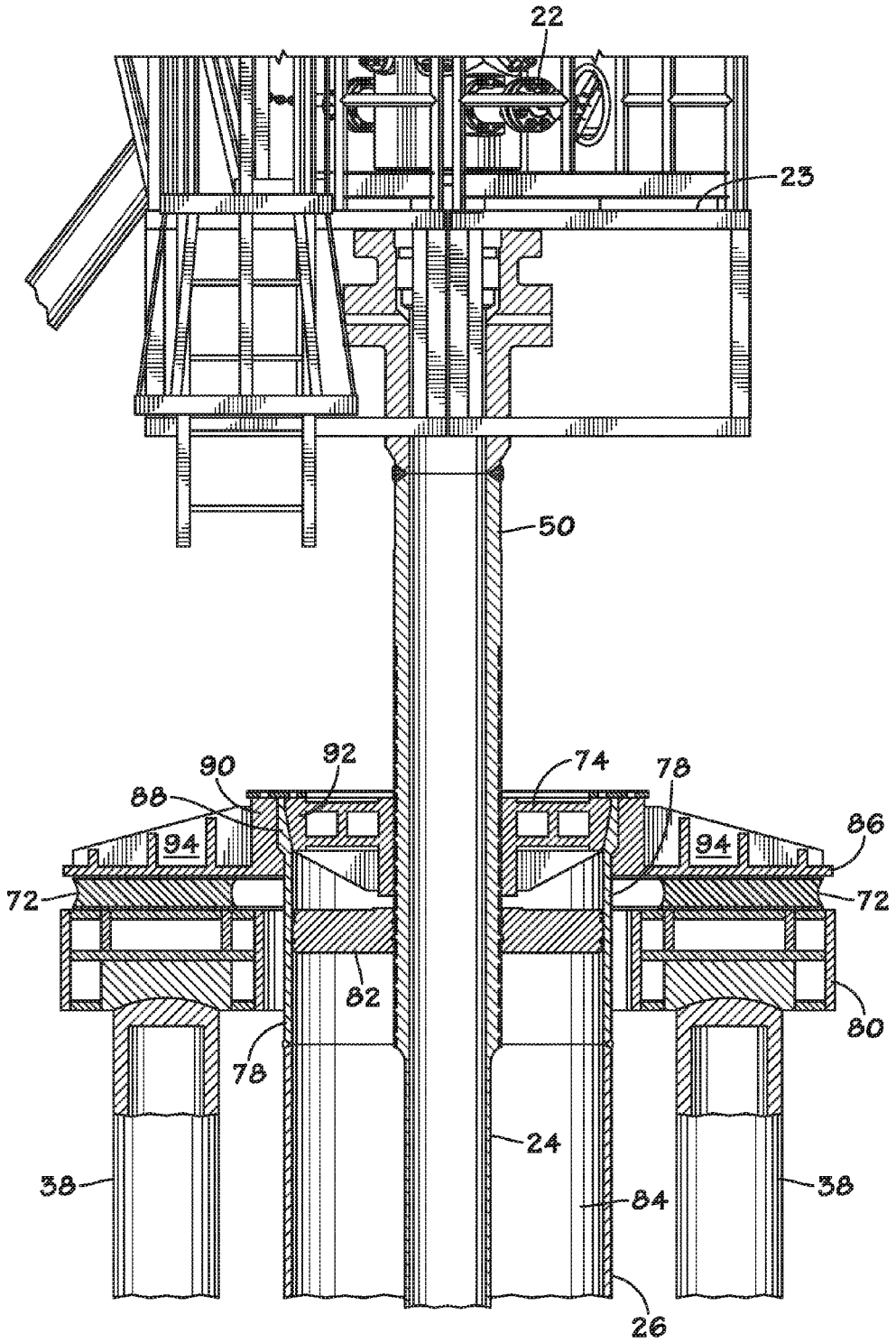
FIG. 4 is a detail side view, partially in cross-section, of the upper tensioner frame and conductor head of the vertical riser tensioning system illustrated in FIG. 3.

As shown in the detailed view of FIG. 4, the upper ends of tensioner rods 38 may bear on the undersurface of upper tensioner frame 80 which may be connected to tension ring 86 via elastomer bearing 72. Reinforcing plates or "radial wings" 94 may connect tension ring 86 to spaceout adapter 74. Spaceout adapter 74 may connect to riser tension joint 50 by engaging threads or grooves on at least a portion of the outer surface of riser tension joint 50 (shown as dashed lines in FIG. 4). In this way, the vertical position of tensioner 20 relative to riser 24 may be adjusted.

Conductor head 78 may be provided with profiled flange 88 which may be engaged between outer land 90 and inner land 92. Upward force applied by tensioner rods 38 is transmitted through upper tensioner frame 80 to elastomer bearing 72 and thence through radial wings 94 to outer land 90 resulting in a tensile force being applied to conductor 26 via flange 88.

Also shown in FIG. 4 is optional conductor sealing plate 82 which may provide a gas-tight seal between the inner surface of conductor 26 and the outer surface of riser 24. This permits annulus 84 to be pressurized with air (or other gas) thereby making conductor 26 positively buoyant (or at least have a lower effective weight). Such buoyancy may act to supplement the tension applied by tensioner 20 which may be particularly advantageous when a cylinder or ram 38 must be removed for maintenance or repair. Examples of means for pressurizing annulus 84 include valves through sealing plate 82, valves through the side wall of conductor 26 and piping entering the open, lower end of conductor 26.

Figure 4A:
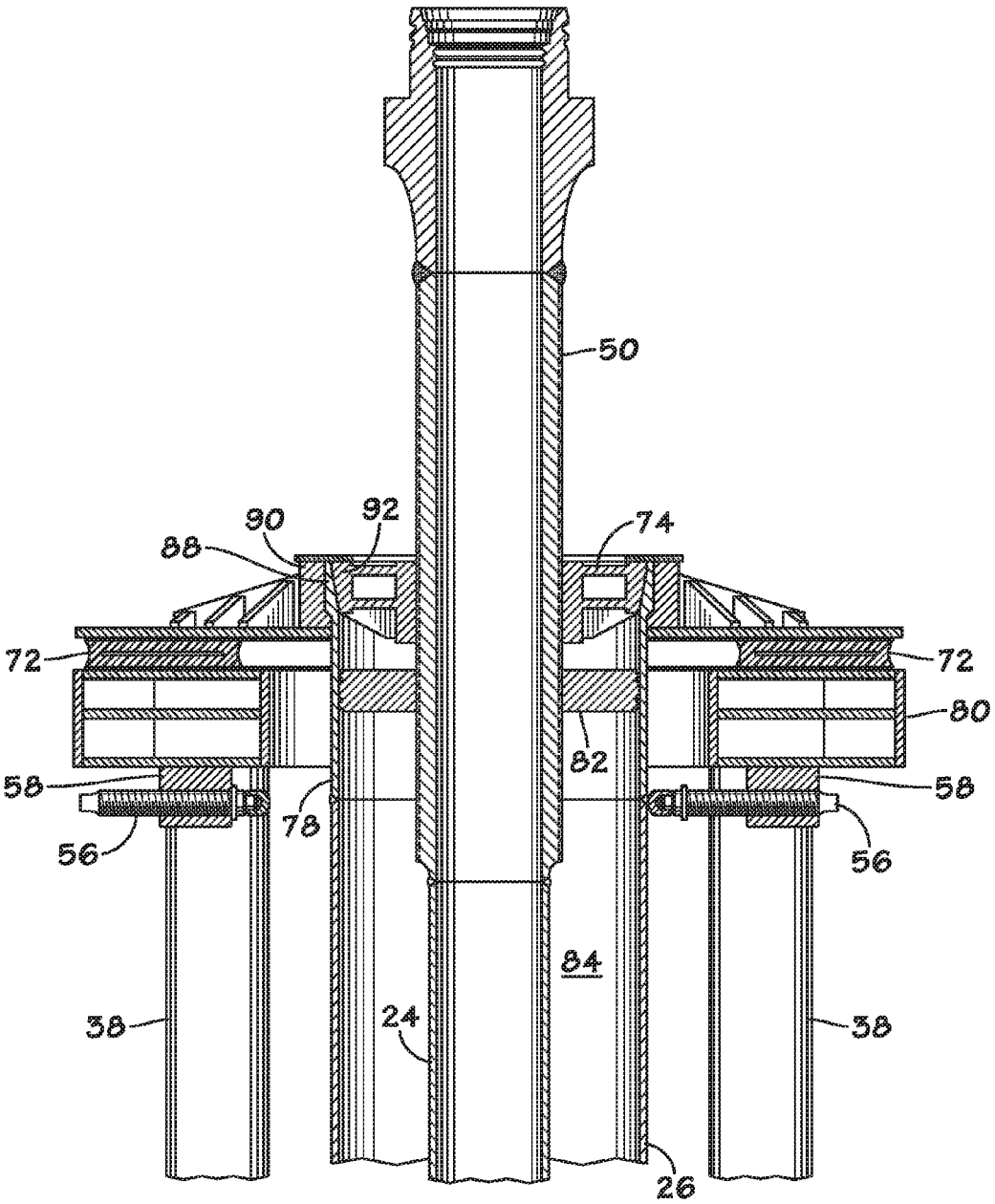
FIG. 4A is a cross-sectional view of the upper tensioner frame and conductor head of a first alternative embodiment of the vertical riser tensioning system illustrated in FIG. 3.

FIG. 4A shows an alternative embodiment wherein top tension ring 80 is equipped with a plurality of attachment blocks 58 on the underside thereof. Attachment blocks 58 may have an internally-threaded, radial through hole with an adjustable centralizer dog 56 in threaded engagement. The outer ends of adjustable centralizer dogs 56 may be provided with wrench flats, hex sockets or other tool-engagement means for adjusting the radial extent thereof.

In one particular, preferred embodiment three adjustable centralizer dogs are provided, each 120° from an adjacent centralizer. Centralizer dogs 58 may be adjusted radially in or out to aid in positioning upper tensioner ring 80 relative to conductor 26. In so doing, the inner ends of centralizer dogs 58 will contact the outer surface of conductor 26 (as shown on the right half of FIG. 4A). Following installation of upper tensioner ring 80, dogs 56 may be retracted by positioning them radially outward (as shown in the left half of FIG. 4A).

Figure 4B:
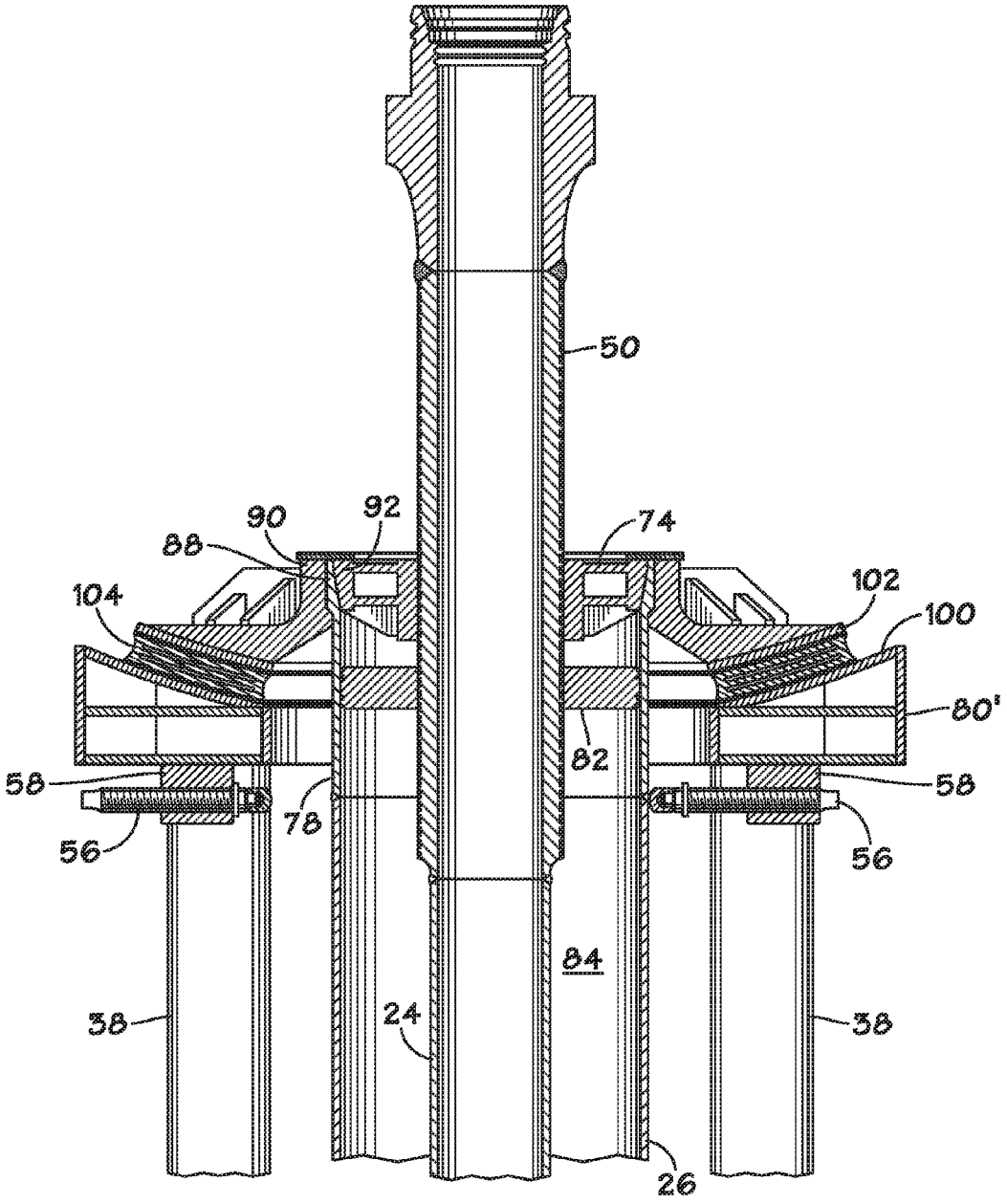
FIG. 4B is a cross-sectional view of the upper tensioner frame and conductor head of a second alternative embodiment of the vertical riser tensioning system illustrated in FIG. 3.

Yet another embodiment is illustrated in FIG. 4B. In this embodiment, upper tensioner frame 80' has concave spherical section 100 and tension ring 86' has opposing, convex spherical surface 102. Spherical section elastomer bearing 104 is positioned between surfaces 100 and 102. This configuration may lessen shear loads applied to bearing 104 when side loads are applied to conductor 26 and/or riser 24. Bearing 104 may be a composite bearing comprised of alternating layers of metal and elastomer.

Figure 5:
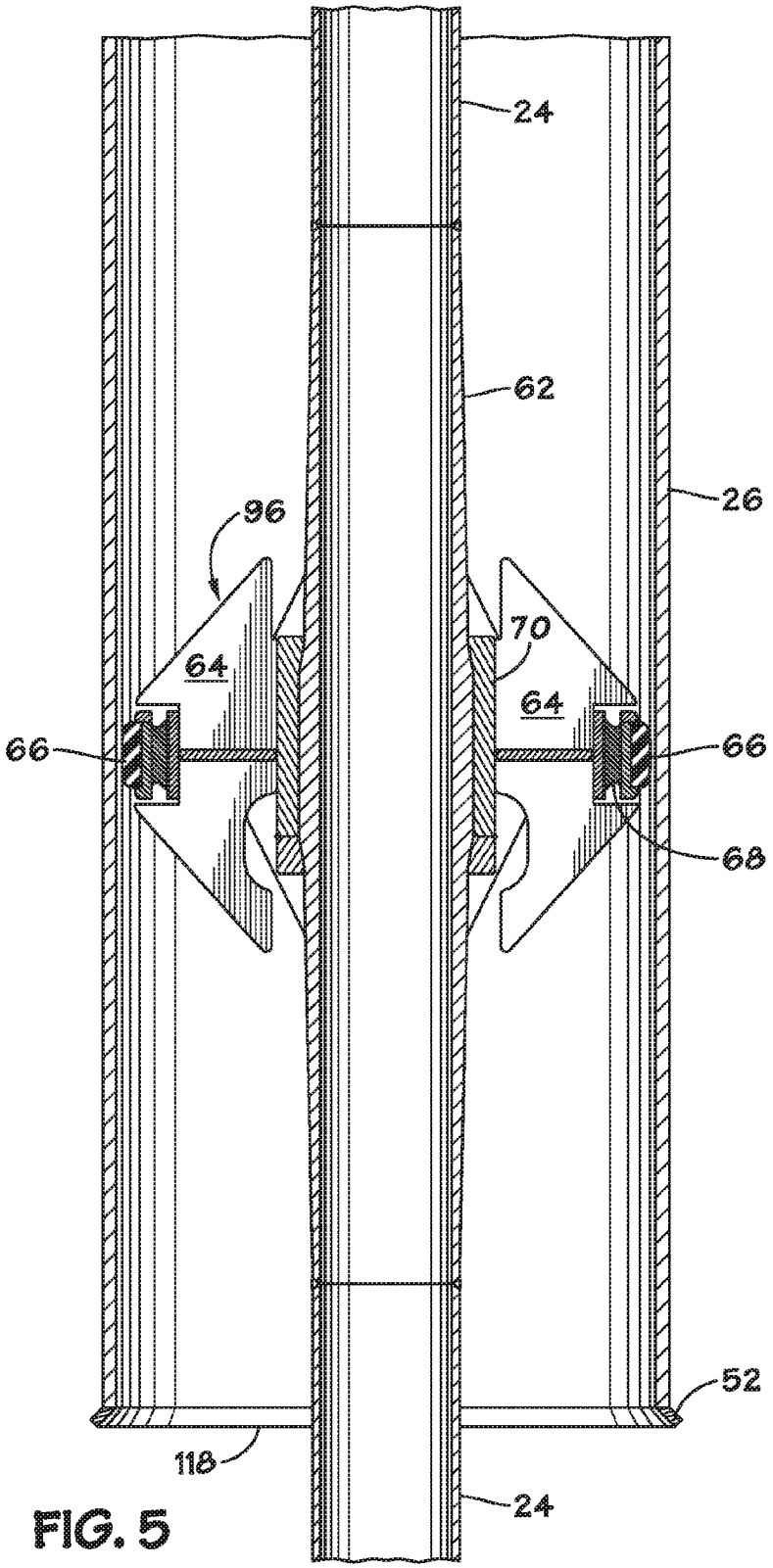
FIG. 5 is a cross-sectional view of the riser keel joint and keel joint centralizer of the vertical riser tensioning system illustrated in FIG. 3.

FIG. 5 is a detailed view of the lower portion of a conductor 26 according to the invention. Conductor 26 may have flare 52 at its lower end to facilitate the installation of riser 24 and its associated centralizers such as keel joint centralizer 96. Centralizer 96 may differ in design from centralizer 48 (see FIG. 3) inasmuch as centralizer 48 may be subjected to lesser lateral loads than keel joint centralizer 96. Riser 24 may include riser keel joint 62 which may have a thicker wall section for added strength and/or a profiled section for securing keel joint centralizer 96 in place.

Keel joint centralizer 96 may comprise centralizer mount 70 which may have a profiled inner surface that engages a corresponding profiled surface on riser 24. Radial spacer plates 64 may be arrayed around mount 70 and support anti-friction bearing 66 on annular elastomeric ring 68. In certain preferred embodiments, anti-friction bearing 66 is fabricated from a polymer selected from the group consisting of nylon, Delrin, polytetrafluoroethylene (PTFE) and polyetheretherketone (PEEK). Other anti-friction materials (which may be composites or metals) suitable for the subsea environment may also be used.

Keel joint centralizer 96 reacts side loads on riser 24 to conductor 26 which is restrained at the keel of semi-submersible vessel 10 by keel guide 28.

Figure 6:
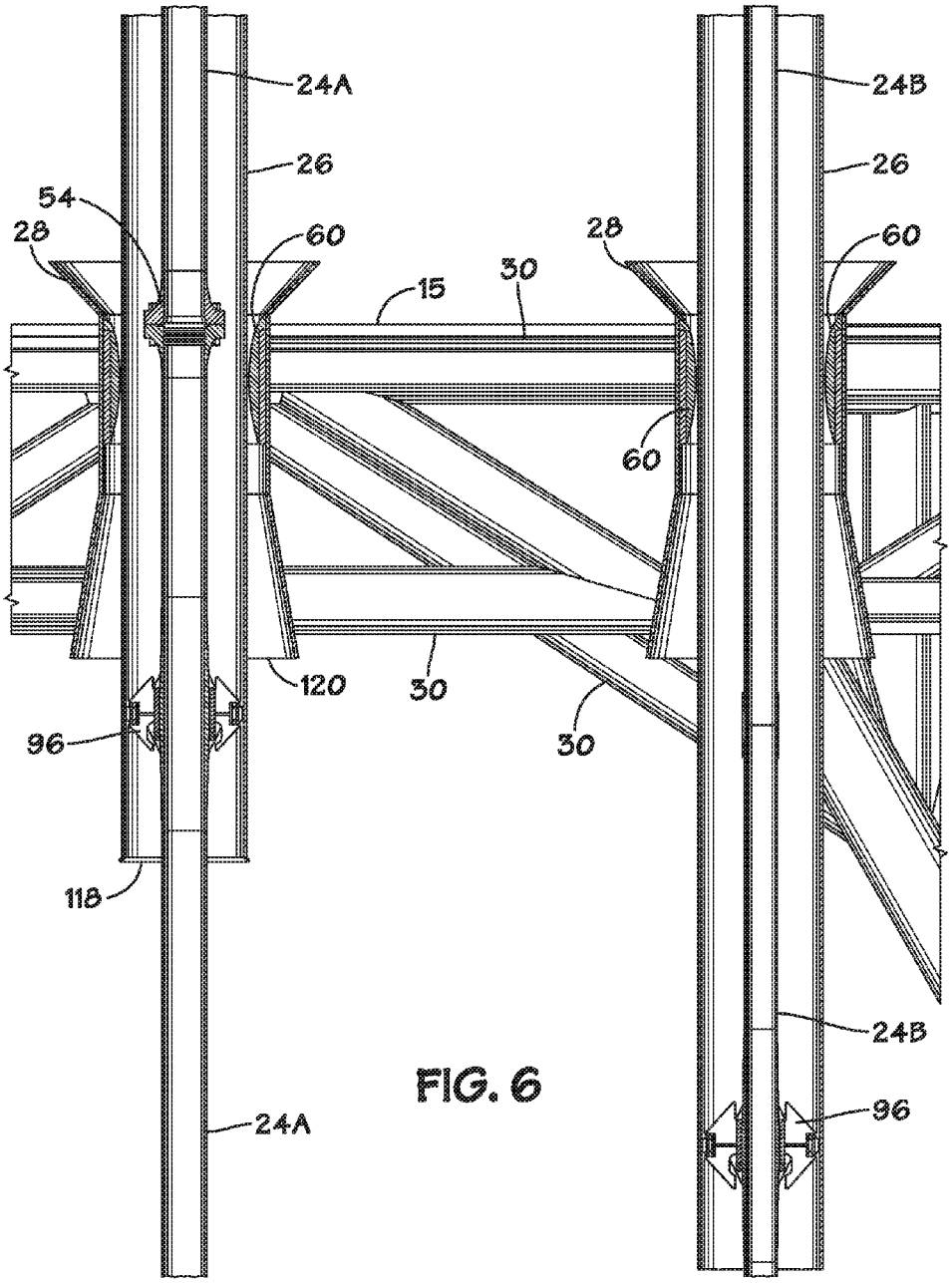
FIG. 6 is a side view, partially in cross-section, of the keel guide hull interface of the vertical riser tensioning system illustrated in FIG. 3.

FIG. 6 shows drilling riser 24A on the left and production riser 24B on the right passing through keel guides 28. Keel guides 28 may have an upper funnel portion for guiding conductor 26 during installation and a lower funnel portion for accommodating bending of conductor 26 in a sideways direction. A portion of keel guide support structure 30 is shown relative to pontoon upper surface 15. Drilling riser 24A includes drilling riser segment connector 54. Production riser 24B includes riser segment connector 55 of differing style.

The central, cylindrical portion of keel guides 28 may have anti-friction bearings 60 for contacting the outer surface of conductor 26 inasmuch as conductor 26 slides axially relative to keel guide 28 as rams 38 of tensioner 20 (not shown in FIG. 6) extend and retract. Anti-friction bearings 60 may be made of any suitable material. Examples of suitable materials include, but are not limited to, nylon, Delrin, polytetrafluoroethylene (PTFE), polyetheretherketone (PEEK), and composites. Anti-friction bearings 60 may be radially segmented for removal and replacement by divers or ROVs.

It will be appreciated by those skilled in the art that the load path for side loads imposed on riser 24A (or 24B) is through keel joint centralizer 96 to conductor 26 and thence through anti-friction bearing 60 to keel guide 28, keel guide support structure 30 and thence to pontoons 14—i.e., the hull of semi-submersible 10. In this way, side loads on risers 24 are substantially reacted to the vessel's hull rather than to the riser tensioners 20. This may simplify the design of tensioners 20 and reduce the wear and stresses imposed thereon. Rather than requiring a gimbaled riser tensioner, one may employ a push-up tensioner having only an elastomer bearing 72 (or 104) for accommodating minor misalignments and to reduce bending moments.

Figure 7:
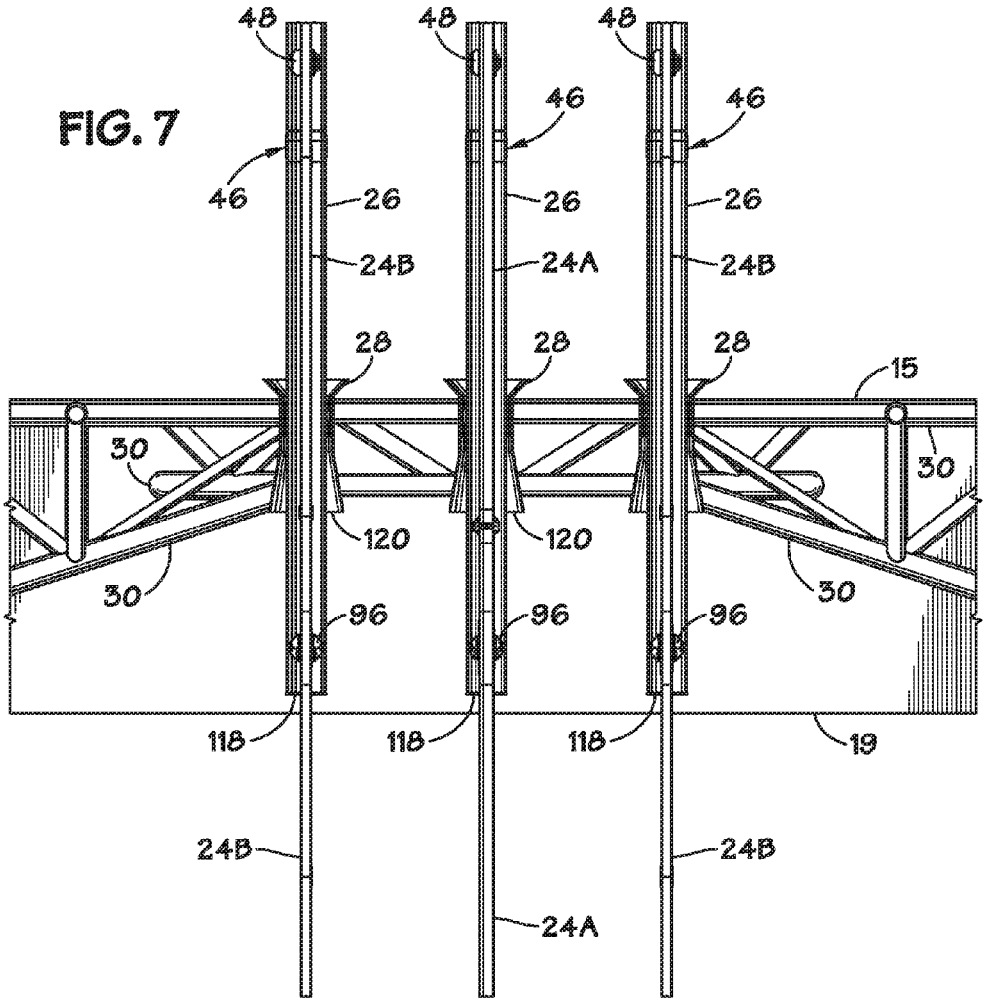
FIG. 7 is a side cross-sectional view of the keel guide hull interface of the vertical riser tensioning system illustrated in FIG. 3 shown in relation to a pontoon of the supporting dry-tree semi-submersible.

FIG. 7 shows keel guide support structure 30 relative to a pontoon 14 having top surface 15 and bottom surface 19. As illustrated in FIG. 7, keel joint centralizers 96 may be located within conductors 26 below lower end 120 of keel guides 28. This may act to take advantage of the flexibility of that portion of conductor 26 which extends below keel guide 28 to further absorb side loads imposed on riser 24—i.e., conductor 26 may bend or flex at keel guide 28 in response to side loading via keel joint centralizer 96.

It should also be noted in FIG. 7 that the lower ends 118 of conductors 26 may be located above the elevation of pontoon bottom surface 19 when their associated tensioners are in their nominal positions. This feature permits conductors 26 to be installed quayside even if the dry-tree semi is ballasted such that pontoon bottom surfaces 19 are resting on the seafloor of the harbor.

In one particular preferred embodiment, mechanical connectors are used to assemble the length of conductor required by the specific platform draft and deck heights. These connectors allow the conductor to be installed or removed offshore using conventional drilling rig operations. This is a significant improvement over the conductors used on spar type platforms that require a heavy-lift vessel crane to be installed or removed. Using the configuration disclosed herein, the conductor may be installed quayside or may be installed offshore.

In one preferred configuration the conductor may be assembled from four sections. The connectors used may be similar to TLP tendon connectors, being fully reversible in connection and disconnection without rotation. The connectors may utilize hydraulic pressure to collapse the pin and expand the box, in conjunction with a hydraulic clamp tool to make up the connections. In one particular preferred embodiment, the conductor connectors have an inside diameter substantially equal to the inside diameter of the conductor pipe to ease the running of the riser and riser centralizers inside the conductor. The pipe sections for the conductor may be similar to tendon pipe, utilizing high quality rolled and welded pipe of high strength.

In order to improve the life and minimize the impact on the tensioning system stiffness from friction, the conductor may be supported by rollers 42 and 44 at the tensioner structure and a keel guide 28 at the pontoon level. The keel guide structure may utilize a low friction composite material to react riser load to the hull. The composite material 60 may be in segments, permitting individual segment removal and replacement without removal of the conductor 26.

Due to the long tensioner strokes required for a DTS, the variability of wave, wind, and currant forces, and the need to minimize overall height of the system, it is possible that the tensioning system may bottom out on rare occasions—i.e., the rams of the tensioner may reach the limit of their downward stroke. The forces generated during these conditions are large, as the riser quickly changes from the relatively soft spring rate of the tensioner to the stiffer spring rate of the steel pipe that forms the riser. To reduce the possibility of damage to the components and the deck or hull structures, an elastomeric pad 72 may be provided at the top of the conductor. This elastomer may provide a bumper function and minimize the impact force. In addition an elastomer ring 68 may be included in the keel joint so that any impact of the production riser at the keel is also minimized.

Previous concepts for DTS tensioning systems have utilized ram tensioning systems based on applications from spar-type vessels. Spars have deep hulls thereby inherently providing guiding means and support for the risers over a long length. For a DTS, the distance between the deck and the pontoons is substantially less. Typical tensioning system design parameters require sufficient remaining capacity in a "one cylinder removed" case. Inasmuch as the riser tensions for dual-string production risers are high, the load capacity lost in a four-cylinder configuration is high. With three remaining cylinders, the moment that must be supported equals one quarter of the nominal load times the radius. By using a six-cylinder configuration, the lost load is only one sixth of the total load. This results in a 33% reduction in the bending moment that must be supported, thereby enhancing system reliability. Moreover, the minimum tension required can be provided by five cylinders instead of three, effectively reducing the nominal tension factor from 4/3 (1.33) to 6/5 (1.2) which provides the possibility to reduce the nominal tension by 11%. With a lower tension factor, the unbalanced moment is also further reduced for a total of 40% less than that of a comparable four-cylinder system.

Referring now to FIG. 8, one particular preferred deck configuration comprises drilling rig substructure 122 above upper deck level 16 and cellar deck 126 below lower deck level 18 of DTS 10. Tensioners 20 are supported on cellar deck 126. Cellar deck vertical support members 128 are attached to the deck framework proximate lower deck level 18 at a first end and to cellar deck frame member 130 at a second end. Having tensioners 20 mounted on cellar deck 126 allows greater access to christmas trees 22 on production risers 24B and BOP 124 on drilling riser 24A and increases the clearance between trees 22 (and BOP 124) and drilling rig substructure 122 when the tensioners are fully stroked up. Cellar deck 126 also provides deck access to the bottom portions of tensioners 20 for inspection and maintenance in mild metocean conditions and the structure of cellar deck 126 may at least partially shield tensioners 20 from wave slamming in severe metocean conditions. Cellar deck 126 may be sufficiently small that the hydrodynamic behavior of the DTS in storm conditions is not adversely affected. The lower extent of cellar deck 126 may be at an elevation that provides no air gap in a 100-year storm.

In a riser system according to the invention, riser conductor 26 may span from the tensioner deck to below the pontoon keel guide on the DTS which protects the riser through the splash zone and also from potential boat or debris impacts. Conductor 26 may be made from multiple sections so as to be field installable or quayside installable. Conductor 26 may have a flush inside surface, with connectors using the "snap together" style Merlin® TLP tendon connectors (Oil States Industries, Inc. Arlington, Tex. 76001) that may be assembled or disassembled on the vessel. The inside diameter of conductor 26 may be selected to permit running drilling and production riser tieback connectors through the inside.

Conductor 26 may be made from thicker wall pipe at the top and bottom, and thinner wall pipe in the middle to reduce weight and increase flexibility.

- The riser keel joint centralizer 96 may be located below the keel guide 28 in order to take full advantage of the conductor flexibility.
- The outside diameter of the conductor 26 interfaces with a keel guide 28 to react side loads from the riser 24.
- The inside surface of the conductor 26 interfaces with a keel joint 62 having a keel centralizer 96.
- The inside of the conductor 26 may be pressurized with air, nitrogen or other suitable gas to increase the tension on the riser 24 by buoyancy of the conductor pie 26.

A bumper system for minimizing impact in the hull, deck, and riser may comprise an elastomeric element 68 as part of the keel joint centralizer 96. An elastomeric element 72 between the conductor head and the upper tensioner frame absorbs shock from axial load of bottoming out and reduces lateral loads.

An example of a suitable tensioner system uses six cylinders with piggy back style composite high-pressure bottles 40 for decreased load variation. Double acting cylinders with fluid contained only on the rod side for seal lubrication may be used.

The tensioner 20 may have a compression cylinder configuration where fluid is contained at the bottom of the cylinder to provide damping at cylinder full down stroke.

A tension joint may be connected to the outer riser to enable space out of the tensioner stroke relative to the riser length.

A keel guide 28 acts to lower the riser lateral load reaction point and overturning moment, thereby improving platform stability.

Segmented composite bearings 60 in keel guide interface with the outer surface of the conductor 26 and may be replaced individually by divers or by a remotely operated vehicle (ROV).

The outside surface of the conductor 26 may be clad with Inconel or similar corrosion resistant material to eliminate potential corrosion damage and reduce friction forces applied to the tensioner 20 and riser 24.

Advantages and benefits of the invention over the existing systems include the following:

a) The conductor 26 extends from the top tensioner frame to the keel joint. The large diameter of the conductor provides guidance for the production riser completely through the hull with full bore.

b) The outside diameter of the conductor reacts on the keel guide 28 and the riser pipe 24 moves with the conductor 26 so there is no relative motion, and hence no wear occurs on the pressure-containing riser pipe 24.

c) The conductor is pre-installable at the shipyard or may be removed or installed offshore.

d) The conductor shields the production risers from splash, surface currents and potential boat impact.

e) The conductor reduces drag loads on the production risers due to surface currents during installation while also reducing the potential for riser clashing.

f) The top of the conductor may incorporate an elastomeric bumper element, for reducing potential impact as a result of bottoming out the tensioning system.

g) The keel guide may incorporate an elastomeric bumper element, that reduces potential impact damage at the riser and keel interface.

h) The keel joint centralizer is spaced to react the lateral riser loads below the keel guide interface. This provides additional flexibility and minimizes potential for clashing between the riser and keel guide.

Benefits to the tensioning system include the following:

a) The large diameter of the conductor 26 reduces bearing stresses at the guide rollers 42 and 44 and on the cylinders to enhance reliability and provide long life.

b) The conductor 26 may comprise sections with reversible connectors based on proven TLP connector technology. This allows installation of additional tensioners in the field and permits removal for maintenance if required.

c) The elastomeric bearing 72 in the upper tensioner frame allows small deflections which reduces lateral load on the cylinder rods 38 thereby enhancing seal life and cylinder durability.

d) One particular preferred arrangement uses tensioners having six cylinders and gas volume attached to the cylinder with composite high-pressure bottles 40. With six cylinders, the volume per cylinder is sufficiently small that the entire gas volume required may be attached to the cylinder, thus minimizing flow losses and enhancing system safety and reliability. In addition, the applied moment is reduced to a more acceptable level should a cylinder need to be removed for maintenance.

e) The tensioner cylinder configuration may use gas only below a piston with fluid on a reduced rod side area to provide lubrication to seals and bearings. The system may use nitrogen as the operating gas to minimize corrosion and enable the use of synthetic, mineral-type fluids.

f) The conductor may be filled with nitrogen, air, or other suitable gas to provide additional riser tension from the resulting buoyancy. This additional tension may supplement the riser hydraulic tension for heavy riser conditions or for hydraulic system maintenance.

Benefits of the system to hull/keel guide include the following:

a) Roller supports 42 and 44 at the tensioner 20 used in conjunction with the keel guide 28 virtually eliminates surface equipment lateral movement, and therefore reduces the well bay spacing requirement.

b) The keel guide wear components may be removed for replacement if required without conductor and riser removal.

Benefits of the invention to the global layout of the platform include the following:

a) Roller supports 42 and 44 at the tensioner 20 in conjunction with the keel guide 28 virtually eliminates surface equipment lateral movement, and therefore reduces the well bay spacing requirement.

b) The conductor 26 is pre-installable at the shipyard, or may be installed offshore. In addition, the conductor 26 may be removed and re-installed offshore.

c) Elimination of large-diameter, high-pressure piping from cylinders to active gas bottles, also known as applied pressure vessels (APV's), which are located away from the tensioner unit and connected by a long run of piping.

d) Riser lateral loads are reacted low on the semi-submersible's hull, thereby improving platform stability for a given draft.

The foregoing presents a particular embodiment of a system embodying the principles of the invention. Those skilled in the art will be able to devise alternatives and variations which, even if not explicitly disclosed herein, embody those principles and are thus within the scope of the present invention as literally and equivalently covered by the following claims.

What is claimed is:

1. A top-tensioned riser system for a dry-tree semi-submersible vessel comprising:

a substantially vertical riser extending upward from a wellhead on the seafloor;

a coaxial conductor surrounding an upper portion of the riser in spaced-apart relation;

a coaxial keel guide surrounding a lower portion of the conductor sized to slidingly engage the conductor;

a tensioner positioned above the coaxial keel guide and attached to the conductor and the riser proximate an upper end of each;

a keel guide support structure attached to the keel guide and the dry-tree, semi-submersible vessel proximate the keel thereof;

a keel joint centralizer attached to the riser proximate the keel guide and sized to substantially prevent radial movement of the riser relative to the conductor, wherein the riser, the conductor, the keel guide, the keel guide support structure, and the keel joint centralizer are configured such that side loads on the riser are reacted from the riser to the conductor via the keel joint centralizer and thence to the keel of the vessel via the keel guide and the keel guide support structure.

2. The top-tensioned riser system recited in claim 1 wherein the keel joint centralizer comprises:

a) a flat keel joint centralizer body having a central bore extending through said body;

b) said keel joint centralizer body including a circumferential flange member defining the perimeter thereof;

c) at least one opening extending through said keel joint centralizer body; and, d) a bearing ring mounted on said flange member.

3. The top-tensioned riser system recited in claim 1 wherein the keel joint centralizer is in sliding engagement with an interior surface of the conductor.

4. The top-tensioned riser system recited in claim 1 wherein the keel joint centralizer is attached to the riser at a location that is below a lower extent of the keel guide and above a lower extent of the conductor.

5. The top-tensioned riser system recited in claim 1 further comprising a spaceout adapter engaging a profile on the conductor and an externally-threaded portion of a riser adjustment joint on the riser proximate the upper end thereof.

6. The top-tensioned riser system recited in claim 1 further comprising a spaceout adapter engaging a profile on the conductor and an externally-grooved portion of a riser adjustment joint on the riser proximate the upper end thereof.

7. The top-tensioned riser system recited in claim 5 further comprising a tension ring attached to and radially disposed from the spaceout adapter.

8. The top-tensioned riser system recited in claim 7 where the conductor is secured between a profile on the upper end of the conductor and lands on the tension ring.

9. The top-tensioned riser system recited in claim 7 further comprising an elastomer bearing on an undersurface of the tension ring said bearing sized and spaced to bear against the upper tensioner frame of the tensioner.

10. The top-tensioned riser system recited in claim 1 further comprising a gas-tight sealing plate sized and spaced to seal an annulus between the riser and the conductor.

11. The top-tensioned riser system recited in claim 10 further comprising means for pressurizing the annulus below the sealing plate with a gas.

12. The top-tensioned riser system recited in claim 1 wherein the tensioner is a ram-type, push-up tensioner.

13. The top-tensioned riser system recited in claim 12 wherein the tensioner comprises double acting cylinders with fluid contained only on a rod side thereof.

14. The top-tensioned riser system recited in claim 9 further comprising a plurality of radially adjustable spacers attached to the top tension ring sized and spaced to contact an outer surface of the conductor in a first, extended position and be in spaced-apart relation to the conductor in a second, retracted position.

15. The top-tensioned riser system recited in claim 9 further comprising an annular, concave, upper surface on a top tension ring and an opposing, annular, convex, lower surface on the upper tensioner frame.

16. The top-tensioned riser system recited in claim 15 further comprising a spherical section elastomer bearing between the concave, upper surface on the top tension ring and the convex, lower surface on the upper tensioner frame.

17. The top-tensioned riser system recited in claim 16 wherein the elastomer bearing comprises alternating laminations of elastomer and metal.

18. The top-tensioned riser system recited in claim 1 wherein the riser comprises a keel joint segment having a greater wall thickness than adjoining segments.

19. The top-tensioned riser system recited in claim 18 further comprising a profile in a wall of the keel joint at the location of the keel joint centralizer.

20. The top-tensioned riser system recited in claim 1 wherein the keel guide comprises a flared upper section, a substantially cylindrical middle section and a flared lower section.

21. The top-tensioned riser system recited in claim 20 wherein the flared lower section has a greater length than the flared upper section.

22. The top-tensioned riser system recited in claim 20 wherein the angle of the flared lower section differs from the angle of the flared upper section.

23. The top-tensioned riser system recited in claim 22 wherein the angle of the flared lower section relative to a central vertical axis of the keel guide is less than the angle of the flared upper section relative to the central vertical axis.

24. The top-tensioned riser system recited in claim 1 wherein the keel guide has an interior surface that is at least partially lined with an anti-friction material.

25. The top-tensioned riser system recited in claim 24 wherein the anti-friction material is radially segmented.

26. The top-tensioned riser system recited in claim 25 wherein the anti-friction material is removable and replaceable with the conductor in place within the keel guide.

27. The top-tensioned riser system recited in claim 1 wherein the conductor is comprised of a plurality of conductor segments joined together with mechanical conductor connectors.

28. The top-tensioned riser system recited in claim 27 wherein the conductor segments are comprised of pipe sections having the same, certain inside diameter and the conductor connectors have a substantially constant inside diameter when assembled, said connector inside diameter being substantially equal to the certain conductor segment inside diameter.

29. A semi-submersible offshore platform comprising:

a hull with a keel and having a plurality of surface-piercing columns;

a plurality of subsurface pontoons interconnecting adjacent columns;

at least one deck supported on upper ends of the columns;

a substantially vertical riser extending upward from a wellhead on the seafloor;

a coaxial conductor surrounding an upper portion of the riser in spaced-apart relation;

a coaxial keel guide surrounding a lower portion of the conductor sized to slidingly engage the conductor;

a tensioner supported on the at least one deck and attached to the conductor and the riser proximate an upper end of each;

a keel guide support structure connected between an opposing pair of pontoons and attached to the keel guide; and, a keel joint centralizer attached to the riser proximate the keel guide and sized to substantially prevent radial movement of the riser relative to the conductor, wherein the riser, the conductor, the keel guide, the keel guide support structure, and the keel joint centralizer are configured such that side loads on the riser are reacted from the riser to the conductor via the keel joint centralizer and thence to the keel of the vessel via the keel guide and the keel guide support structure.

30. The semi-submersible offshore platform recited in claim 29 wherein the keel guide support structure is comprised of an open framework.

31. The semi-submersible offshore platform recited in claim 29 wherein the elevation of the keel guide is about the same as the elevation of an upper surface of a pontoon.

32. The semi-submersible offshore platform recited in claim 29 wherein the conductor has a length such that a lower extent of the conductor is above a plane defined by the lower extent of the plurality of pontoons at least when the tensioner is in a fully extended state.

33. The semi-submersible offshore platform recited in claim 29 further comprising a cellar deck attached to and disposed generally below the at least one deck supported on upper ends of the columns.

34. The semi-submersible offshore platform recited in claim 33 wherein the cellar deck has a lower extent that provides no air gap in a 100-year storm.

35. A method for reacting side loads on a top-tensioned, vertical riser supported by a tensioner on a dry-tree, semi-submersible vessel comprising:

surrounding an upper portion of a vertical riser with a coaxial conductor in spaced-apart relation, the conductor connected at an upper end thereof to a riser tensioner also connected to the vertical riser;

passing the conductor and riser through a coaxial keel guide attached to the semi-submersible vessel proximate the keel thereof with a keel guide support structure and sized to slidingly engage the conductor;

providing a keel joint centralizer attached to the riser proximate the keel guide, the keel joint centralizer sized to substantially prevent radial movement of the riser relative to the conductor; and, reacting a side load applied to the riser to the conductor via the keel joint centralizer and thence to the keel of the vessel via the keel guide and the keel guide support structure.

* * * * *